US008606135B2

(12) United States Patent
Yamashina et al.

(10) Patent No.: US 8,606,135 B2
(45) Date of Patent: Dec. 10, 2013

(54) FIXING DEVICE AND IMAGE FORMING APPARATUS EMPLOYING THE FIXING DEVICE

(75) Inventors: Ryota Yamashina, Yamato (JP); Akira Shinshi, Machida (JP); Kenichi Hasegawa, Atsugi (JP); Hiroshi Yoshinaga, Ichikawa (JP); Yasunori Ishigaya, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 402 days.

(21) Appl. No.: 12/880,327

(22) Filed: Sep. 13, 2010

(65) Prior Publication Data

US 2011/0064437 A1 Mar. 17, 2011

(30) Foreign Application Priority Data

Sep. 15, 2009 (JP) ..... 2009-212791

(51) Int. Cl.
*G03G 15/20* (2006.01)

(52) U.S. Cl.
USPC ..... 399/67; 399/324; 399/329

(58) Field of Classification Search
USPC ..... 399/67, 69, 324, 325, 328, 329, 334; 219/216; 430/124.34, 124.36, 124.37
See application file for complete search history.

(56) References Cited

U.S. PATENT DOCUMENTS

| | | | | |
|---|---|---|---|---|
| 6,131,009 | A | 10/2000 | Hasegawa | 399/328 |
| 6,496,666 | B2 | 12/2002 | Hayashi et al. | 399/69 |
| 6,498,911 | B2 * | 12/2002 | Hiroki et al. | 399/69 |
| 6,591,081 | B2 | 7/2003 | Hasegawa | 399/324 |
| 6,628,916 | B2 | 9/2003 | Yasui et al. | 399/329 |
| 6,636,709 | B2 | 10/2003 | Furukawa et al. | 399/69 |
| 6,778,790 | B2 | 8/2004 | Yoshinaga et al. | 399/69 |
| 6,778,804 | B2 | 8/2004 | Yoshinaga et al. | 399/325 |
| 6,785,505 | B2 | 8/2004 | Yasui et al. | 399/329 |
| 6,881,927 | B2 | 4/2005 | Yoshinaga et al. | 219/216 |
| 6,882,820 | B2 | 4/2005 | Shinshi et al. | 399/328 |
| 6,892,044 | B2 | 5/2005 | Yasui et al. | 399/324 |
| 7,022,944 | B2 | 4/2006 | Yoshinaga et al. | 219/216 |

(Continued)

FOREIGN PATENT DOCUMENTS

| | | |
|---|---|---|
| CN | 1515966 | 7/2004 |
| CN | 1629750 | 6/2005 |

(Continued)

OTHER PUBLICATIONS

Office Action issued Feb. 28, 2013, in Chinese Patent Application No. 201010284438.9.

(Continued)

*Primary Examiner* — Sophia S Chen
(74) *Attorney, Agent, or Firm* — Oblon, Spivak, McClelland, Maier & Neustadt, L.L.P.

(57) ABSTRACT

A fixing device for fixing an image on a recording medium includes an endless flexible fixing member formed into a loop, a heat conductive member disposed within the loop formed by the fixing member, a heater disposed near the heat conductive member to heat the heat conductive member, a pressing member pressing the fixing member against the heat conductive member to form a fixing nip, a temperature sensor detecting a temperature of the fixing member, and a lubricant disposed between the fixing member and the heat conductive member. The heater heats the heat conductive member to heat the lubricant with the fixing member stopped. The fixing member rotates after heating of the heat conductive member by the heater.

18 Claims, 11 Drawing Sheets

(56) References Cited

U.S. PATENT DOCUMENTS

| | | | | |
|---|---|---|---|---|
| 7,070,182 | B2 | 7/2006 | Hasegawa | 271/307 |
| 7,127,204 | B2 | 10/2006 | Satoh et al. | 399/329 |
| 7,151,907 | B2 | 12/2006 | Yoshinaga | 399/333 |
| 7,239,838 | B2 | 7/2007 | Sato et al. | 399/329 |
| 7,242,897 | B2 | 7/2007 | Satoh et al. | 399/329 |
| 7,313,353 | B2 | 12/2007 | Satoh et al. | 399/329 |
| 7,330,682 | B2 | 2/2008 | Shinshi | 399/122 |
| 7,379,698 | B2 | 5/2008 | Yoshinaga | 399/329 |
| 7,414,640 | B2 * | 8/2008 | Furuyama | 399/69 X |
| 7,454,151 | B2 | 11/2008 | Satoh et al. | 399/69 |
| 7,509,085 | B2 | 3/2009 | Yoshinaga et al. | 399/325 |
| 7,515,850 | B2 | 4/2009 | Hasegawa | 399/124 |
| 7,546,049 | B2 | 6/2009 | Ehara et al. | 399/69 |
| 7,593,680 | B2 | 9/2009 | Shinshi | 399/329 |
| 7,630,652 | B2 | 12/2009 | Hasegawa | 399/13 |
| 7,742,714 | B2 | 6/2010 | Shinshi et al. | 399/68 |
| 2002/0136562 | A1 | 9/2002 | Hiroki et al. | 399/69 |
| 2004/0165897 | A1 * | 8/2004 | Hooper et al. | 399/67 X |
| 2006/0029411 | A1 | 2/2006 | Ishii et al. | 399/67 |
| 2006/0257183 | A1 | 11/2006 | Ehara et al. | 399/405 |
| 2007/0003334 | A1 | 1/2007 | Shinshi et al. | 399/327 |
| 2007/0014600 | A1 | 1/2007 | Ishii et al. | 399/328 |
| 2007/0059071 | A1 | 3/2007 | Shinshi et al. | 399/400 |
| 2007/0292175 | A1 | 12/2007 | Shinshi | 399/329 |
| 2008/0063443 | A1 | 3/2008 | Yoshinaga et al. | 399/328 |
| 2008/0112739 | A1 | 5/2008 | Shinshi | 399/329 |
| 2008/0175633 | A1 | 7/2008 | Shinshi | 399/329 |
| 2008/0219730 | A1 | 9/2008 | Shinshi | 399/333 |
| 2008/0253788 | A1 | 10/2008 | Shinshi | 399/69 |
| 2008/0253789 | A1 | 10/2008 | Yoshinaga et al. | 399/69 |
| 2008/0298862 | A1 | 12/2008 | Shinshi | 399/324 |
| 2008/0317532 | A1 | 12/2008 | Ehara et al. | 399/400 |
| 2009/0041515 | A1 * | 2/2009 | Kim | 399/324 |
| 2009/0067902 | A1 | 3/2009 | Yoshinaga et al. | 399/329 |
| 2009/0123202 | A1 | 5/2009 | Yoshinaga et al. | 399/329 |
| 2009/0148204 | A1 | 6/2009 | Yoshinaga et al. | 399/328 |
| 2009/0169232 | A1 | 7/2009 | Kunjii et al. | 399/70 |
| 2009/0196643 | A1 * | 8/2009 | Mito et al. | 399/69 |
| 2009/0245865 | A1 | 10/2009 | Shinshi et al. | 399/122 |
| 2009/0297199 | A1 | 12/2009 | Yamashina et al. | 399/70 |
| 2009/0311016 | A1 | 12/2009 | Shinshi | 399/329 |
| 2010/0061754 | A1 | 3/2010 | Ishigaya et al. | 399/70 |
| 2010/0092220 | A1 | 4/2010 | Hasegawa et al. | 399/328 |
| 2010/0092221 | A1 | 4/2010 | Shinshi et al. | 399/330 |
| 2010/0104307 | A1 * | 4/2010 | Shinyama | 399/68 |
| 2010/0202809 | A1 | 8/2010 | Shinshi et al. | 399/329 |
| 2011/0044734 | A1 * | 2/2011 | Shimokawa et al. | 399/324 X |

FOREIGN PATENT DOCUMENTS

| | | | |
|---|---|---|---|
| JP | 05-019555 | A * | 1/1993 |
| JP | 9-138597 | | 5/1997 |
| JP | 10-213984 | | 8/1998 |
| JP | 2884714 | B2 | 2/1999 |
| JP | 2000-221830 | | 8/2000 |
| JP | 2000-338801 | | 12/2000 |
| JP | 3298354 | B2 | 4/2002 |
| JP | 2007-334205 | | 12/2007 |
| JP | 2008-20533 | | 1/2008 |
| JP | 2008-40268 | | 2/2008 |

OTHER PUBLICATIONS

Office Action issued Jul. 1, 2013 in Japanese patent Application No. 2009-212791.

* cited by examiner $x2 \geqq x1/2$ x1 : LENGTH OF LUBRICANT COVER AREA ( —·—·— )

x2: LENGTH OF HEATED AREA ( ------ )

FIXING DEVICE AND IMAGE FORMING APPARATUS EMPLOYING THE FIXING DEVICE

CROSS-REFERENCE TO RELATED APPLICATIONS

The present patent application claims priority pursuant to 35 U.S.C. §119 from Japanese Patent Application No. 2009-212791, filed on Sep. 15, 2009 in the Japan Patent Office, which is incorporated herein by reference in its entirety.

BACKGROUND OF THE DISCLOSURE

1. Field of the Disclosure

Exemplary embodiments of the present disclosure relate to a fixing device and an image forming apparatus including the fixing device, and more specifically, to a fixing device that applies heat and pressure to a recording medium at a nip between a fixing belt and a pressing member to fix an image on the recording medium and an image forming apparatus including the fixing device.

2. Description of the Background

As one type of image forming apparatus, electrophotographic image forming apparatuses are widely known. In an image formation process executed by an electrophotographic image forming apparatus, for example, a charger uniformly charges a surface of an image carrier (e.g., photoconductive drum); an optical writing unit emits a light beam onto the charged surface of the image carrier to form an electrostatic latent image on the image carrier according to image data; a development device supplies toner to the electrostatic latent image formed on the image carrier to make the electrostatic latent image visible as a toner image; the toner image is directly transferred from the image carrier onto a recording medium or indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

FIG. 1 is a schematic configuration view illustrating a conventional belt-type fixing device. In FIG. 1, the belt-type fixing device includes a heating roller 202, a fixing roller 203, a fixing belt 204, and a pressing roller 205. The heating roller 202 includes a heater 201. The fixing roller 203 includes a rubber layer on its surface. The fixing belt 204 is stretched between the heating roller 202 and the fixing roller 203. The pressing roller 205 presses against the fixing roller 203 via the fixing belt 204 to form a fixing nip N.

When a toner image is transferred onto a recording medium P, the recording medium P is conveyed to the fixing nip N between the fixing belt 204 and the pressing roller 205. When the recording medium P passes the fixing nip N, heat and pressure are applied to the toner image on the recording medium P to fix the toner image.

FIG. 2 is a schematic configuration view illustrating a conventional film-type fixing device. As described in JP-H04-044075-A, typically, a ceramic heater 211 and a pressing roller 212 sandwich a heat-resistant film (fixing belt) 213 to form the fixing nip N.

A recording sheet is fed to the fixing nip N between the heat-resistant film 213 and the pressing roller 212. Then, the recording sheet is sandwiched by the heat-resistant film 213 and the pressing roller 212 to be conveyed together with the heat-resistant film 213.

The film-type fixing device may be an on-demand type fixing device including a ceramic heater and a film member of low heat capacity. Further, in an image forming apparatus including the fixing device, only during image formation, the ceramic heater may be turned on to generate heat at a certain fixing temperature to shorten a waiting time required from turning-on of the image forming apparatus to a state ready for image formation and reduce the power consumption at a standby mode.

Finally, a conventional pressing-belt-type fixing device like that described in JP-H08-262903-A includes a heat fixing roller, an endless belt, and a pressing pad. The heat fixing roller is rotatable and has an elastically deformable surface. The endless belt travels in contact with the heat fixing roller. The pressing pad is fixedly mounted inside a loop formed by the endless belt and presses the endless belt against the heat fixing roller to form a belt nip between the endless belt and the heat fixing roller through which the recording medium passes.

According to the pressing-belt-type fixing device described above, pressure of the pressing pad elastically deforms the surface of the heat fixing roller and extends a contact area of the heat fixing roller and the recording medium to enhance heat conduction efficiency, reduce energy consumption, and achieve downsizing.

However, for example, in the above-described film-type fixing device described in JP-H04-044075-A, there is room for improvement in durability and temperature stability of the fixing belt.

For example, the abrasion resistance of a sliding surface between the ceramic heater and the fixing belt made of heat-resistant film may be insufficient. When the fixing belt is driven for an extended period of time, the sliding surface is worn out. Accordingly, traveling of the fixing belt may become unsteady and/or the driving torque of the fixing device may increase. Consequently, the recording medium may slip on the fixing belt, causing displacement of a resultant image. Alternatively, increased stress may be applied to a driving gear, causing damage to the gear.

Further, in the film-type fixing device, the fixing belt is partially heated at the fixing nip. The temperature of the fixing belt is at its lowest when the fixing belt in rotation returns to an entrance of the fixing nip, causing faulty fixing particularly at high-speed rotation.

To reduce the friction between the fixing belt and the ceramic heater or other stationary member, for example, JP-H08-262903-A describes the fixing device using a fiberglass sheet impregnated with polytetrafluoroethylene (PTFE) as a low-friction sheet (a sheet-shaped slide member) on a surface layer of the pressing pad.

However, in the above-described pressing-belt-type fixing device, a large heat capacity of the fixing roller may increase the time required for raising the temperature of the fixing roller, thereby extending the warm-up time.

To deal with such challenges, JP-2007-334205-A proposes a fixing device including an endless fixing belt and a heat conductive member of metal fixed in a loop formed by the endless fixing belt. In the fixing device, lubricant is provided between the endless fixing belt and the heat conductive member to reduce the friction resistance caused when the endless belt slides against the heat conductive member.

In the above-described fixing device of film-heating or pressing-belt type, such a sliding portion between the endless belt and the heat conductive member is limited to the fixing nip or a nearby portion thereof. On the other hand, in the fixing device described in JP-2007-334205-A, the endless belt slides over a substantially entire circumference of the heat conductive member. Thus, lubricant needs to cover the substantially entire circumference of the sliding portion.

However, in the configuration described in JP-2007-334205-A, since the viscosity of lubricant is high at low temperatures, the friction resistance of the sliding portion is increased, causing an increased torque applied to a motor serving as a driving unit. Consequently, stability in the rotation speed of the motor might be reduced.

SUMMARY

In at least one exemplary embodiment, there is provided an improved fixing device for fixing an image on a recording medium. The fixing device includes an endless flexible fixing member, a heat conductive member, a heater, a pressing member, a temperature sensor, and a lubricant. The fixing member is formed into a loop. The heat conductive member is disposed within the loop formed by the fixing member. The fixing member is movable along the heat conductive member. The heater is disposed near the heat conductive member to heat the heat conductive member. The pressing member presses the fixing member against the heat conductive member to form a fixing nip between the heat conductive member and the pressing member. The recording medium passes through the fixing nip. The temperature sensor detects a temperature of the fixing member. The lubricant is disposed between the fixing member and the heat conductive member. The heater heats the heat conductive member to heat the lubricant with the fixing member stopped. The fixing member rotates after heating of the heat conductive member by the heater.

In at least one exemplary embodiment, there is provided an improved image forming apparatus including an image forming unit that forms an image on a recording medium and a fixing device that fixes the image, formed by the image forming unit, on the recording medium. The fixing device includes an endless flexible fixing member, a heat conductive member, a heater, a pressing member, a temperature sensor, and a lubricant. The fixing member is formed into a loop. The heat conductive member is disposed within the loop formed by the fixing member. The fixing member is movable along the heat conductive member. The heater is disposed near the heat conductive member to heat the heat conductive member. The pressing member presses the fixing member against the heat conductive member to form a fixing nip between the heat conductive member and the pressing member. The recording medium passes through the fixing nip. The temperature sensor detects a temperature of the fixing member. The lubricant is disposed between the fixing member and the heat conductive member. The heater heats the heat conductive member to heat the lubricant with the fixing member stopped. The fixing member rotates after heating of the heat conductive member by the heater.

In at least one exemplary embodiment, there is provided an improved method of fixing an image on a recording medium using a fixing device. The fixing device includes a fixing member and a heat conductive member disposed in close proximity to each other. The method includes stopping rotation of the fixing member, heating the heat conductive member to heat a lubricant disposed between the fixing member and the heat conductive member, and restarting rotation of the fixing member.

BRIEF DESCRIPTION OF THE DRAWINGS

Additional aspects, features, and advantages will be readily ascertained as the same becomes better understood by reference to the following detailed description when considered in connection with the accompanying drawings, wherein:

FIG. 15 is a diagram illustrating a temperature distribution of the fixing belt obtained with the end-portion halogen heaters turned on;

DETAILED DESCRIPTION OF EXEMPLARY EMBODIMENTS

Figure 1:
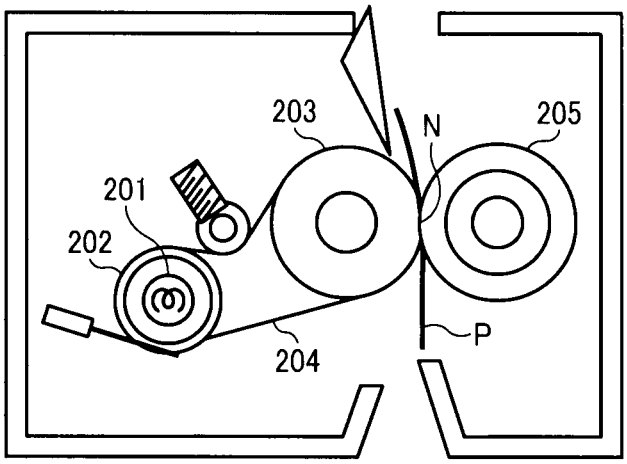
FIG. 1 RELATED ART
FIG. 1 is a schematic view illustrating a conventional type of fixing device.
Figure 2:
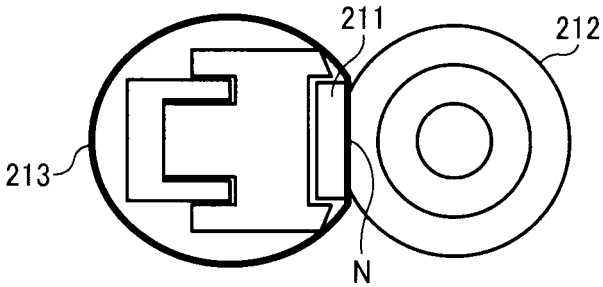
FIG. 2 RELATED ART
FIG. 2 is a schematic elevation view illustrating another conventional type of fixing device.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

It is to be noted that, in the description below, reference characters Y, M, C, and K attached to the end of each reference numeral indicate only that components indicated thereby are used for forming yellow, magenta, cyan, and black images, respectively, and hereinafter may be omitted when color discrimination is not necessary.

Referring now to the drawings, wherein like reference numerals designate identical or corresponding parts throughout the several views, in particular to FIG. 3, an image forming apparatus 1 according to an exemplary embodiment of the present disclosure is described below.

Figure 3:
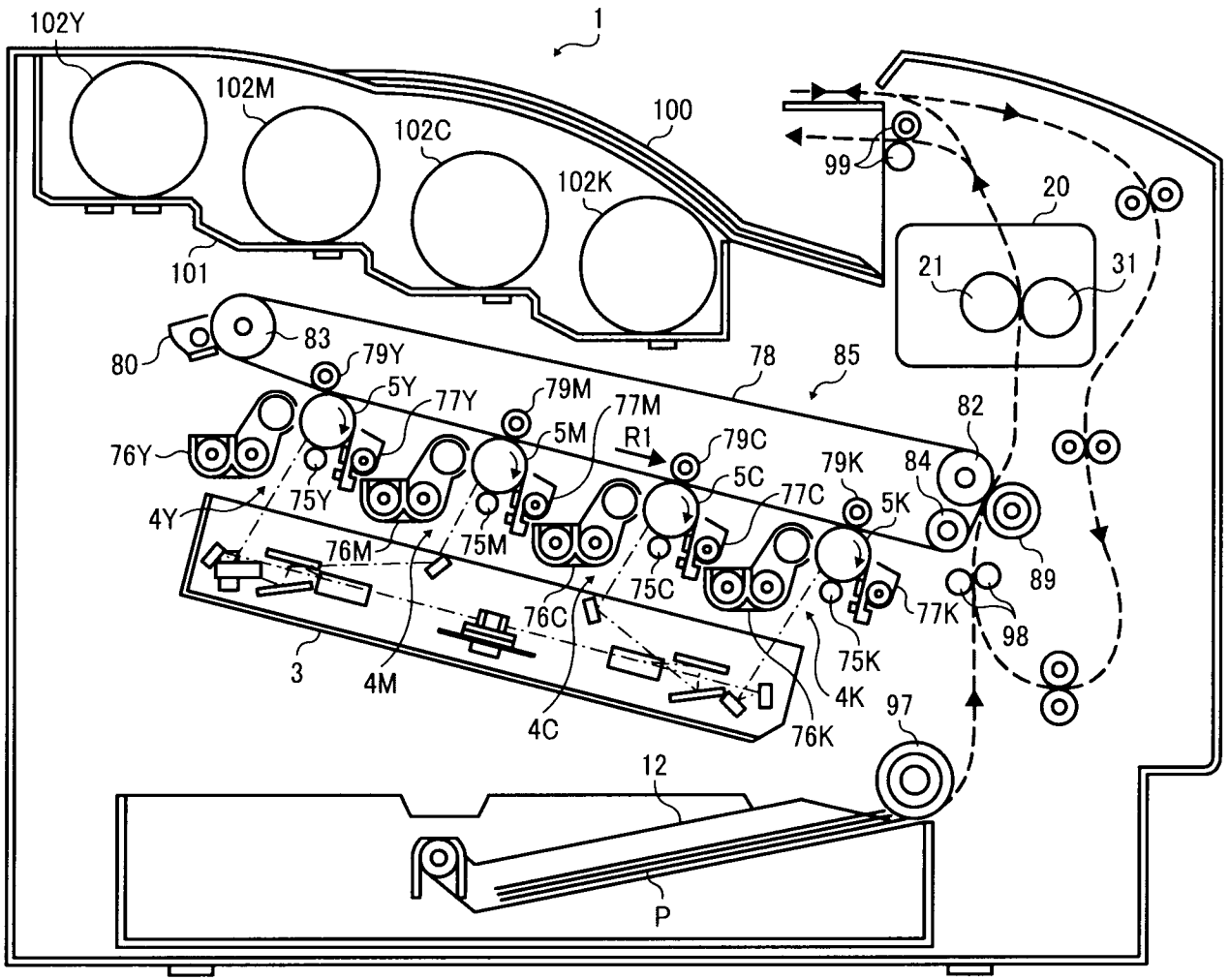
FIG. 3 is a schematic elevation view illustrating a configuration of an image forming apparatus according to an exemplary embodiment of the present disclosure.

FIG. 3 is a schematic elevation view illustrating a configuration of the image forming apparatus 1 according to exemplary embodiments of the present disclosure.

In FIG. 3, the image forming apparatus 1 is illustrated as a tandem color printer for forming a color image on a recording medium. However, it is to be noted that the image forming apparatus 1 may be a copier, a facsimile machine, a printer, a multifunctional peripheral having at least two of copying, printing, scanning, plotter, facsimile capabilities, and the like.

As illustrated in FIG. 3, the image forming apparatus 1 includes an exposure device 3, image forming devices 4Y, 4M, 4C, and 4K, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K. The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively.

Image forming processes including a charging process, an exposure process, a development process, a first transfer process, and a cleaning process are performed on the rotating photoconductive drums 5Y, 5M, 5C, and 5K to form yellow, magenta, cyan, and black toner images on the photoconductive drums 5Y, 5M, 5C, and 5K, respectively.

The following describes the image forming processes performed on the photoconductive drums 5Y, 5M, 5C, and 5K.

A driving motor drives and rotates the photoconductive drums 5Y, 5M, 5C, and 5K clockwise in FIG. 3. In the charging process, the chargers 75Y, 75M, 75C, and 75K are disposed opposite the photoconductive drums 5Y, 5M, 5C, and 5K, respectively, and uniformly charge surfaces of the photoconductive drums 5Y, 5M, 5C, and 5K.

In the exposure process, the exposure device 3 emits laser beams L onto the charged surfaces of the photoconductive drums 5Y, 5M, 5C, and 5K to expose the charged surfaces of the photoconductive drums 5Y, 5M, 5C, and 5K, respectively, so as to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images, respectively.

In the first transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78. Thus, a color toner image is formed on the intermediate transfer belt 78.

After the transfer of the yellow, magenta, cyan, and black toner images, the surfaces of the photoconductive drums 5Y, 5M, 5C, and 5K from which the yellow, magenta, cyan, and black toner images are transferred reach positions at which the cleaners 77Y, 77M, 77C, and 77K are disposed opposite the photoconductive drums 5Y, 5M, 5C, and 5K, respectively. In the cleaning process, cleaning blades included in the cleaners 77Y, 77M, 77C, and 77K mechanically collect residual toner remaining on the surfaces of the photoconductive drums 5Y, 5M, 5C, and 5K from the photoconductive drums 5Y, 5M, 5C, and 5K, respectively. Thereafter, dischargers remove residual potential on the surfaces of the photoconductive drums 5Y, 5M, 5C, and 5K, respectively, thus completing a single sequence of image forming processes performed on the photoconductive drums 5Y, 5M, 5C, and 5K.

The following describes a series of transfer processes performed on the intermediate transfer belt 78.

The intermediate transfer unit 85 includes the endless, intermediate transfer belt 78, the four first transfer bias rollers 79Y, 79M, 79C, and 79K, the second transfer backup roller 82, the cleaning backup roller 83, the tension roller 84, and the intermediate transfer cleaner 80.

The intermediate transfer belt 78 is supported by and stretched over the second transfer backup roller 82, the cleaning backup roller 83, and the tension roller 84. The second transfer backup roller 82 drives and rotates the intermediate transfer belt 78 in a direction R1.

The first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively.

As the intermediate transfer belt 78 moves in the direction R1 and passes through the first transfer nips formed between the intermediate transfer belt 78 and the photoconductive drums 5Y, 5M, 5C, and 5K successively, the yellow, magenta, cyan, and black toner images formed on the photoconductive drums 5Y, 5M, 5C, and 5K, respectively, are transferred and superimposed onto the intermediate transfer belt 78 at the first transfer nips formed between the photoconductive drums 5Y, 5M, 5C, and 5K and the intermediate transfer belt 78. Thus, a color toner image is formed on the intermediate transfer belt 78.

After the first transfer process, an outer circumferential surface of the intermediate transfer belt 78 bearing the color toner image reaches a position at which the second transfer roller 89 is disposed opposite the intermediate transfer belt 78. At this position, the second transfer roller 89 and the second transfer backup roller 82 sandwich the intermediate transfer belt 78 to form the second transfer nip between the second transfer roller 89 and the intermediate transfer belt 78. At the second transfer nip, the second transfer roller 89 transfers the color toner image formed on the intermediate transfer belt 78 onto the recording medium P fed by the registration roller pair 98 in a second transfer process.

After the second transfer process, when the outer circumferential surface of the intermediate transfer belt 78 reaches a position at which the intermediate transfer cleaner 80 is disposed opposite the intermediate transfer belt 78, the intermediate transfer cleaner 80 collects residual toner from the intermediate transfer belt 78, thus completing a single sequence of transfer processes performed on the intermediate transfer belt 78.

In this regard, the recording medium P is fed from the paper tray 12 to the second transfer nipping position via the feed roller 97 and the registration roller pair 98.

The paper tray 12 is provided in a lower portion of the image forming apparatus 1, and loads a plurality of recording media p (e.g., transfer sheets).

The feed roller 97 rotates counterclockwise in FIG. 3 to feed an uppermost recording medium P of the plurality of recording media P loaded on the paper tray 12 toward the registration roller pair 98.

The registration roller pair 98, which stops rotating temporarily, stops the uppermost recording medium P fed by the feed roller 97. For example, a roller nip of the registration roller pair 98 contacts and stops a leading edge of the recording medium P temporarily.

The registration roller pair 98 resumes rotating to feed the recording medium P to the second transfer nip, formed between the second transfer roller 89 and the intermediate transfer belt 78, as the color toner image formed on the intermediate transfer belt 78 reaches the second transfer nip.

Thus, the color toner image is transferred on the recording medium P.

The recording medium P bearing the color toner image is sent to the fixing device 20. In the fixing device 20, the fixing belt 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

Figure 4:
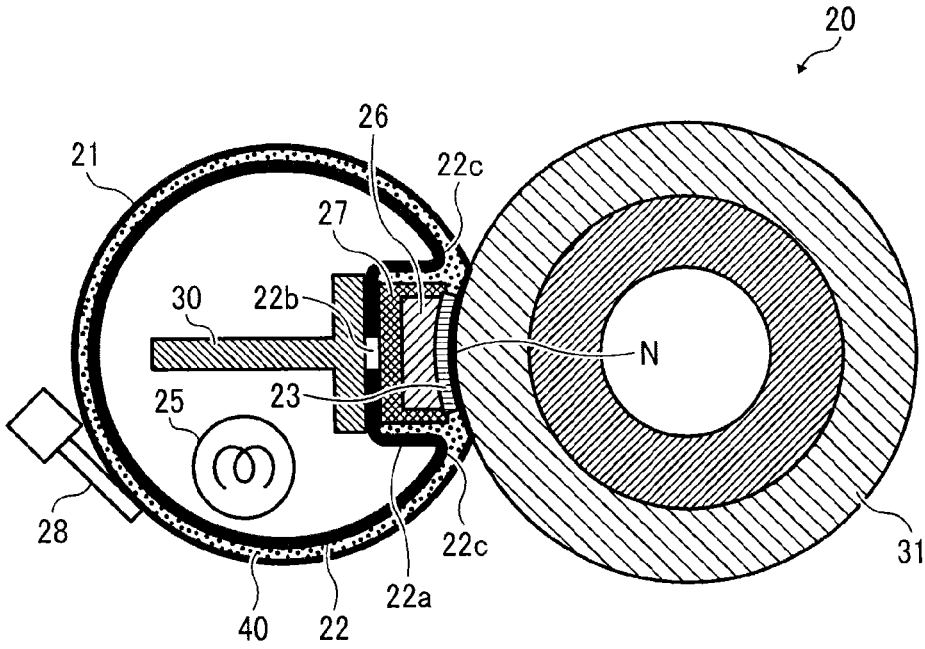
FIG. 4 is a cross-sectional elevation view illustrating a fixing device according to an exemplary embodiment.

FIG. 4 is a cross-sectional elevation view illustrating the fixing device 20 according to a first exemplary embodiment of the present disclosure.

In FIG. 4, the fixing device 20 includes the fixing belt 21, a heat conductive member 22, a halogen heater 25, a thermistor 28, and a pressing roller 31. The fixing belt 21 is an endless belt member serving as a fixing member. The heat conductive member 22 has a pipe shape and is disposed inside a loop formed by the fixing belt 21. The heat conductive member 22 conducts heat to the fixing belt 21 and supports the fixing belt 21 as a supporting member. The halogen heater 25 is a heating member, and the thermistor 28 is a temperature sensor to detect a surface temperature of the fixing belt 21 in contact with the fixing belt 21. The pressing roller 31 is a pressing member disposed in contact with the fixing belt 21 to form a fixing nip N.

The heat conductive member 22 includes a recessed portion 22*a*opposite the fixing nip N. At the recessed portion 22*a*are disposed a nip formation member 26, a lubrication sheet 23 of, e.g., a mesh type between the fixing belt 21 and the nip formation member 26, and a heat insulator 27 between the nip formation member 26 and a bottom of the recessed portion 22*a*.

The fixing device 20 also includes a pressing support member 30 that presses the nip formation member 26 via the recessed portion 22*a*. Thus, the nip formation member 26 is pressed against the pressing roller 31 to form the fixing nip N.

The nip formation member 26 is formed of an elastic material, such as silicone rubber or fluorocarbon rubber, and indirectly slides over an inner surface of the fixing belt 21 via the lubrication sheet 23. Alternatively, the nip formation member 26 may directly slide over the inner surface of the fixing belt 21.

The recessed portion 22*a*of the heat conductive member 22 is not limited to the recessed shape and may be a flat shape or any other suitable shape. However, with the recessed shape, the discharge direction of the front tip of the recording medium P is close to the pressing roller 31. Such a configuration allows the recording medium P to more easily separate from the fixing belt 21, preventing sheet jam.

The pressing roller 31 includes a hollow metal roller having a silicone rubber layer. A releasing layer, such as a perfluoroalkoxy (PFA) resin layer or a polytetrafluoroethylene (PTFE) resin layer, is formed on an outer surface of the pressing roller 31 to obtain good releasing property.

The pressing roller 31 is rotated by a driving force transmitted from a driving source, such as a motor, disposed in the image forming apparatus via gears. Further, the pressing roller 31 is pressed against the fixing belt 21 by a spring or other member. As a result, the rubber layer of the pressing roller 31 is squashed and deformed to form a certain width of the fixing nip N.

It is to be noted that the pressing roller 31 may be formed of a solid roller. However, a hollow roller is preferable in that the heat capacity is relatively small. The pressing roller 31 may include a heat source such as a halogen heater.

The silicone rubber layer of the pressing roller 31 may be solid rubber. Alternatively, if a heat source, such as a heater, is not provided in the pressing roller 31, the silicone rubber layer may be made of sponge rubber. Sponge rubber is preferable in that the insulation performance is relatively high and thus less of the heat of the fixing belt 21 is transmitted to the pressing roller 31.

The fixing belt 21 is an endless belt (or film) including nickel, stainless, or other metal or polyimide resin or other resin. The fixing belt 21 has a releasing layer, such as a PFA resin layer or a PTFE resin layer on its surface to prevent toner on the recording medium from adhering to the fixing belt 21.

A silicone rubber layer or other elastic layer may be formed between the substrate of the fixing belt 21 and the PFA (or PTFE) resin layer. If the silicone rubber layer is not provided, the heat capacity of the fixing belt 21 is relatively small, enhancing the fixing performance. However, when an unfixed toner image is compressed by the surface of fixing belt 21, minute irregularity of the surface of the fixing belt 21 may be transferred on the toner image, causing minute irregularity on a solid portion of the toner image.

To prevent such irregularity, the silicone rubber layer may be formed with a thickness of, e.g., 100 um or more. Deformation of the silicone rubber layer can absorb such minute irregularity, preventing formation of an irregular toner image.

The heat conductive member 22 has a pipe shape and includes a metal such as aluminum, iron, and/or stainless steel. The heat conductive member 22 according to the present exemplary embodiment has a circular shape of a diameter which is, e.g., 1 mm smaller than a diameter of the fixing belt 21.

However, it is to be noted that the cross-sectional shape of the fixing belt 21 is not limited to the circular shape and may be a rectangular shape.

The nip formation member 26 and the heat insulator 27 are put in the recessed portion 22*a*of the heat conductive member 22. The pressing support member 30 is provided inside the heat conductive member 22 to support the recessed portion 22*a*, the nip formation member 26, and the heat insulator 27.

In such a configuration, the pressing support member 30 might be heated by, e.g., radiation heat of the halogen heater 25. In such a case, the surface of the pressing support member 30 may be insulated or mirror-finished to prevent heating. Such a configuration can prevent wasteful heat energy consumption.

It is to be noted that the heat source to heat the heat conductive member 22 is not limited to the halogen heater 25 as illustrated in FIG. 4 and may be, e.g., an induction heater described below. Further, a resistance heater or a carbon heater may be employed.

In the fixing device 20 illustrated in FIG. 4, the fixing belt 21 is heated via the heat conductive member 22. Alternatively, the fixing belt 21 may be directly heated by a heat source.

The fixing belt 21 rotates in accordance with rotation of the pressing roller 31. In FIG. 4, the pressing roller 31 is rotated by a driving source, and the drive force of the pressing roller 31 is transmitted to the fixing belt 21 at the fixing nip N to rotate the fixing belt 21.

The fixing belt 21 is sandwiched with the nip formation member 26 and the pressing roller 31 to rotate. The fixing belt 21 is guided by the heat conductive member 22 in an area other than the fixing nip N, preventing the position of the fixing belt 21 from moving away from the heat conductive member 22 beyond a certain distance.

Figure 5:
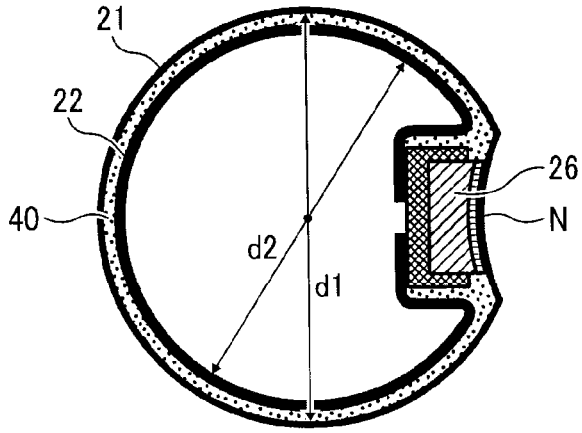
FIG. 5 is a schematic view illustrating lubricant disposed between a fixing belt and a heat conductive member.

In the present exemplary embodiment, as illustrated in FIG. 5, a difference (d1−d2) between a diameter d1 of the fixing belt 21 and a diameter d2 of the pipe-shaped heat conductive member 22 is set within 1 mm to effectively conduct heat from the heat conductive member 22 to the fixing belt 21.

A lubricant 40, such as silicone oil or fluorine grease, may be applied to an interface portion between the fixing belt 21 and the heat conductive member 22 at a gap which is the difference between dl and d2. The lubricant 40 is provided between the fixing belt 21 and the heat conductive member 22 to reduce the friction resistance of the fixing belt 21 and the heat conductive member 22.

Such a configuration provides a reduced warm-up time at an inexpensive cost and allows the heat conductive member 22 to effectively disperse heat and conduct heat to the entire fixing belt 21 in a uniform manner. Thus, the fixing device 20 can stabilize the temperature of the entire fixing belt 21.

In the fixing device having the above-described configuration, the lubricant 40 applied to the interface between the fixing belt 21 and the heat conductive member 22 reduces the friction resistance at the interface portion. However, if the friction resistance is relatively great, the load (torque) at the sliding portion between the fixing belt 21 and the heat conductive member 22 might still increase beyond the driving torque of the pressing roller 31, damaging a rotary drive unit, such as a motor.

In general, the lower the temperature of the lubricant, the higher the viscosity of the lubricant. By contrast, the higher the temperature of the lubricant, the lower the viscosity of the lubricant. At low temperature, the friction resistance of the sliding portion between the fixing belt 21 and the heat conductive member 22 is high, causing an increased torque or load on related connecting members.

In the present exemplary embodiment, as illustrated in FIG. 5, the lubricant 40 covers substantially the entire area of the interface between the fixing belt 21 and the heat conductive member 22. Thus, in the present exemplary embodiment, the degree of increase in the friction resistance caused by a decrease in the temperature of the lubricant 40 is relatively large as compared to the configuration in which the sliding portion of the fixing belt 21 and the heat conductive member 22 is limited to the fixing nip N.

In the present exemplary embodiment, as illustrated in FIG. 4, the thermistor 28 is provided to detect the temperature of the fixing belt 21.

In the present exemplary embodiment, a contact-type thermistor is used as a temperature detector to detect the temperature of the fixing belt 21. Alternatively, a non-contact type thermistor or thermopile may be used as the temperature detector.

In the present exemplary embodiment, as illustrated in FIG. 5, fluorine grease is the lubricant 40 used in across substantially the entire area of the interface between the fixing belt 21 and the heat conductive member 22 to reduce the contact resistance between the fixing belt 21 and the heat conductive member 22. It is to be noted that the lubricant 40 is not limited to fluorine grease and may, for example, be silicone oil.

Figure 6:
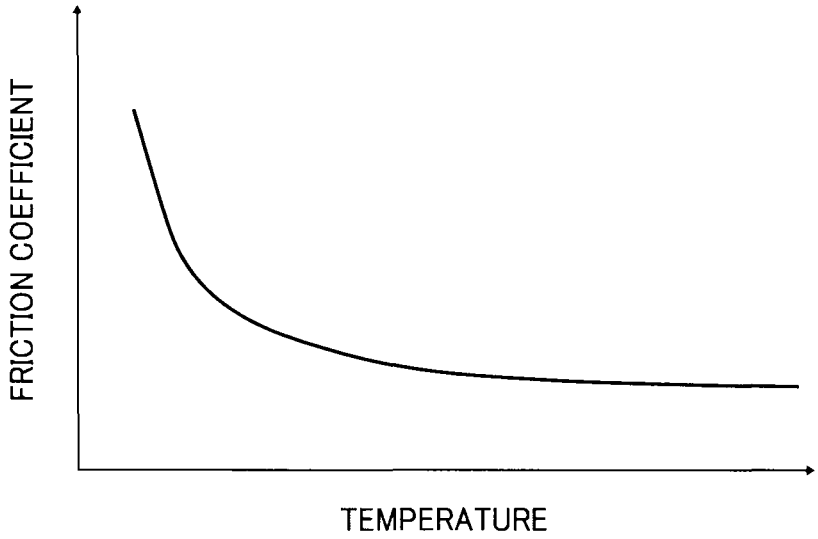
FIG. 6 is a chart illustrating a relation between temperature of fluorine grease and friction coefficient of the fixing belt contacting the heat conductive member.

FIG. 6 is a chart illustrating a relation between the temperature of fluorine grease and the friction coefficient of the fixing belt contacting the heat conductive member.

As illustrated in FIG. 6, as the temperature of fluorine grease rises, the viscosity of fluorine grease decreases and thus the friction coefficient of the fixing belt 21 contacting the heat conductive member 22 decreases.

As described above, when the fixing belt 21 slides against the heat conductive member 22 with an increased temperature of fluorine grease and a reduced friction coefficient, the load or torque caused at the sliding portion between the fixing belt 21 and the heat conductive member 22 decreases, preventing a motor for rotating the pressing roller 31 or other driving source from being damaged.

In the present exemplary embodiment, by increasing the temperature of the lubricant 40 in the interface between the fixing belt 21 and the heat conductive member 22, the friction coefficient at the interface decreases, reducing the load on the driving source. Accordingly, as the area covered with the lubricant 40 is greater, the greater load-reduction effect can be obtained.

Figure 7:
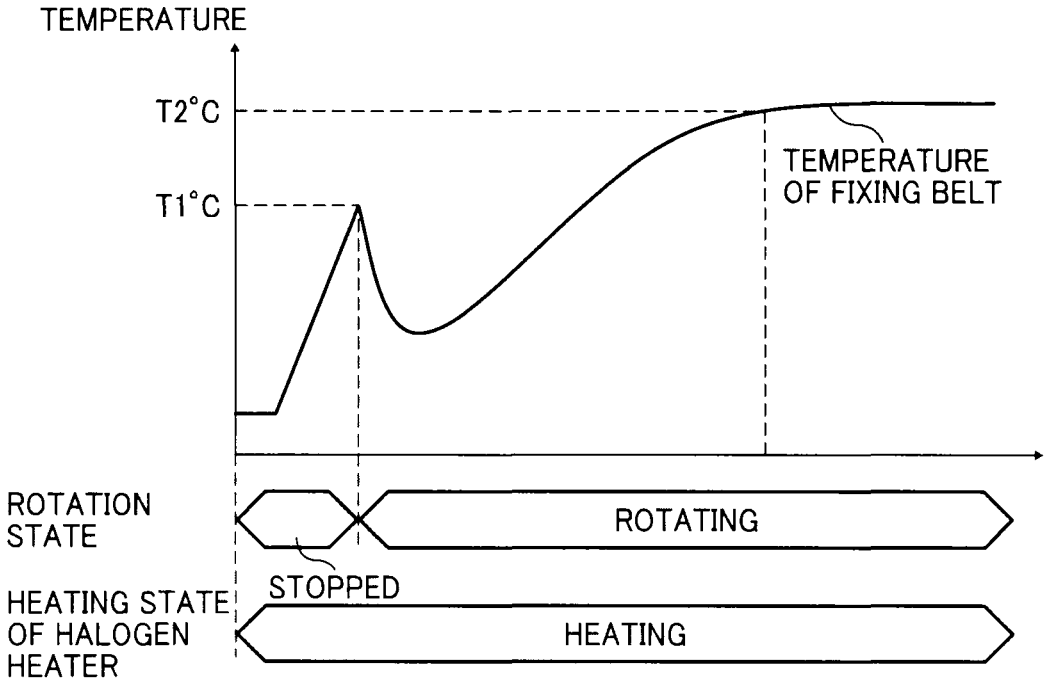
FIG. 7 is a chart illustrating temperature transition of a thermistor.
Figure 8:
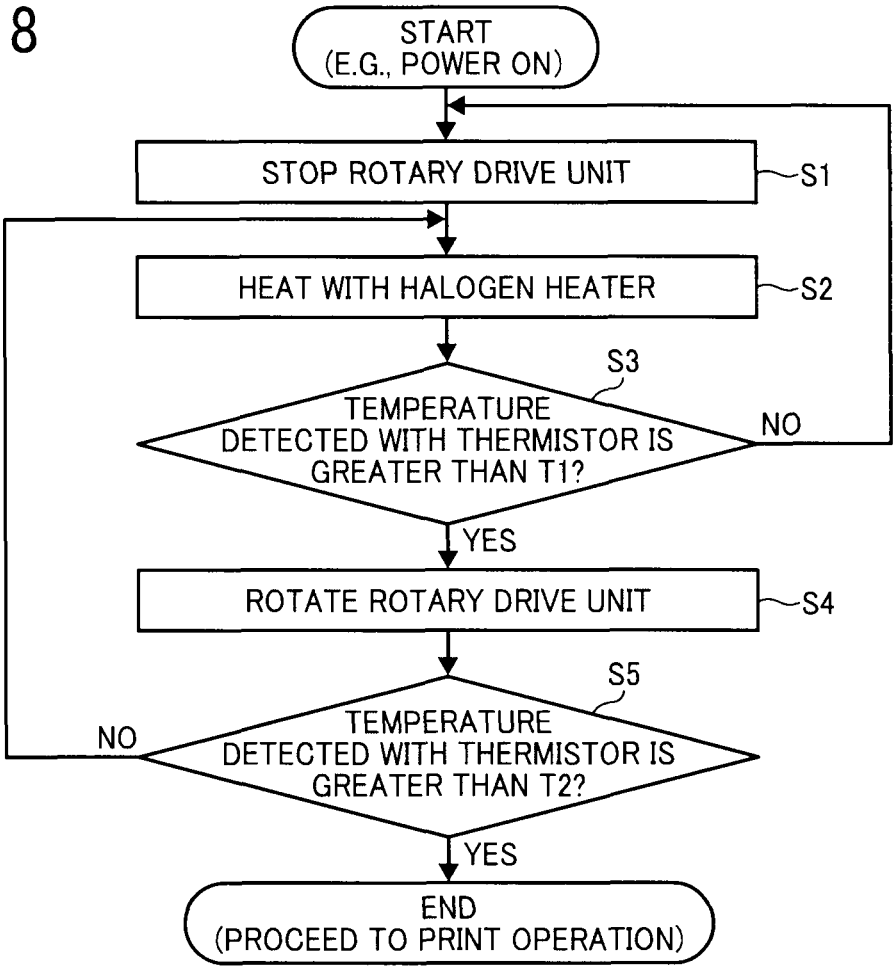
FIG. 8 is a flowchart illustrating a heating control procedure.

Next, the heating control in the present exemplary embodiment is described with reference to FIGS. 7 and 8. FIG. 7 is a chart illustrating temperature transition of the thermistor. FIG. 8 is a flowchart illustrating a heating control procedure.

When the fixing device is turned off or in a power-saving mode, the temperature of the fixing belt 21 is relatively low (e.g., 50 degrees C. or lower).

In this state, when the fixing device is turned on by a user or receives a print request from an image forming apparatus, the rotary drive unit driving the pressing roller 31 is stopped at S1, and the fixing belt 21 is heated in preparation for printing (step S2).

The thermistor 28 monitors the temperature of the fixing belt 21. If the temperature detected by the thermistor 28 is lower than a predetermined temperature T1 degrees C. ("NO" at step S3), the fixing belt 21 is stopped and the halogen heater 25 is heated (hereinafter "stationary heating"). Then, once the temperature detected by the thermistor 28 reaches T1 degrees C. ("YES" at S3), at step S4 the rotary drive unit starts to drive to apply a rotary drive force to the pressing roller 31. Thus, the fixing belt 21 is rotated by the rotary drive force to make the temperature of the fixing belt 21 in the circumferential direction thereof uniform. When the temperature detected by the thermistor 28 reaches a printable temperature T2 degrees C. ("YES" at step S5), the process proceeds to the printing operation.

As described above, in the present exemplary embodiment, the temperature of the fixing belt 21 is monitored. When the temperature is at a predetermined temperature or more and the viscosity of the lubricant 40 is lowered, the fixing belt 21 is rotated. Such a configuration allows the fixing belt 21 to slide against the heat conductive member 22 with the interface between the fixing belt 21 and the heat conductive member 22 maintained at a low friction resistance. Accordingly, the load or torque at the sliding portion can be reduced, preventing overload of the rotary drive unit.

Generally, to reduce power consumption or extend the product life by shortening traveling distance, an image forming apparatus may maintain the fixing member at a given temperature with the fixing member stopped while printing is not performed. In such a case, only upon receiving a print request does the image forming apparatus start to rotate the fixing member.

Such an operational shift from stationary heating to rotational heating may be generally performed by using a print request as a trigger to start the rotation driving, which is different from the shift between rotation operations performed under the heating control including stationary heating of the present exemplary embodiment.

In other words, in the present exemplary embodiment, when the power is turned on or the temperature of the fixing belt rises from a low-temperature state, such as a power-saving mode, stationary heating is performed at temperatures lower than a predetermined temperature. Only after the temperature exceeds the predetermined temperature does rotational heating, i.e., rotational driving, start. Such a configuration provides a proper viscosity of lubricant to reduce the contact friction force between the fixing belt and the heat conductive member, preventing damage to the rotary drive unit and related/connection members of the fixing belt or roller.

In the present exemplary embodiment, stationary heating ends when the temperature of the thermistor 28 reaches 100 degrees C. or more (e.g., at T1=100 degrees C. in FIG. 7).

Figure 9:
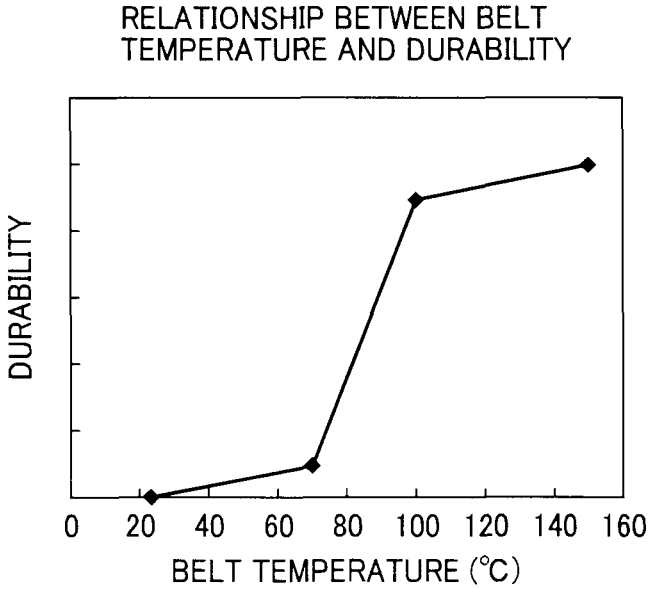
FIG. 9 is a chart illustrating a relation between temperature and durability of the fixing belt.

FIG. 9 is a chart illustrating durability of the fixing belt obtained when the pressing roller continues to be driven with the temperature of the fixing belt maintained at a certain temperature in accordance with the temperature detected by the thermistor 28.

The term "durability" used herein means a time taken until it is difficult to continue rotating the pressure roller due to wear of or damage to a driving gear of the rotary drive unit.

As illustrated in FIG. 9, by rotating the pressing roller 31 at a temperature of 100 degrees C. or more, the friction resistance of the lubricant 40 at the sliding portion between the fixing belt 21 and the heat conductive member 22 decreases. Accordingly, the torque occurring at the sliding portion becomes sufficiently smaller relative to an tolerable torque of the rotary drive unit, significantly increasing the durability.

As described above, in the present exemplary embodiment, when the temperature of the thermistor 28 is lower than 100 degrees C., stationary heating is performed. When the temperature of the thermistor 28 reaches 100 degrees C., the pressing roller starts to be driven to perform rotational heating. Such a configuration reduces the load or torque on the pressing roller 31, preventing damage or breakage of the rotary drive unit.

Next, a second exemplary embodiment of the fixing device is described below.

In the following description, the same reference characters are allocated to members corresponding to those described above and redundant descriptions thereof are omitted below.

In the second exemplary embodiment, the drive-rotation speed of the pressing roller 31 is controlled in accordance with the temperature detected by the thermistor 28.

Figure 10:
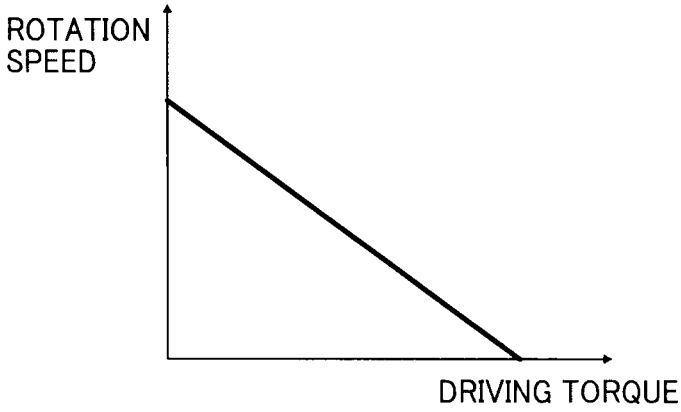
FIG. 10 is a chart illustrating a relation between driving torque of a rotary drive unit and rotation speed of a pressing roller.

FIG. 10 is a chart illustrating relation between the driving torque of the rotary drive unit and the rotation speed of the pressing roller 31.

As illustrated in FIG. 10, when the power supplied to the rotary drive unit is constant, the driving torque is inversely proportional to the rotation speed in a linear way.

Hence, in the second exemplary embodiment, like the first exemplary embodiment, the thermistor 28 illustrated in FIG. 4 monitors the temperature of the fixing belt 21.

When the power is turned on or the temperature of the fixing belt rises from a low temperature state, such as a power-saving mode, the temperature of the fixing belt 21 may be relatively low and the friction resistance of the fixing belt and the heat conductive member may be relatively large. In such a case, by reducing the rotation speed of the fixing belt 21, the driving torque of the rotary drive unit increases. As the temperature of the fixing belt 21 rises, the rotation speed is raised to reduce the driving torque.

As described above, the rotation speed of the fixing belt 21 is controlled in accordance with information on the temperature of the fixing belt 21, preventing damage to the rotary drive unit.

Figure 11A:
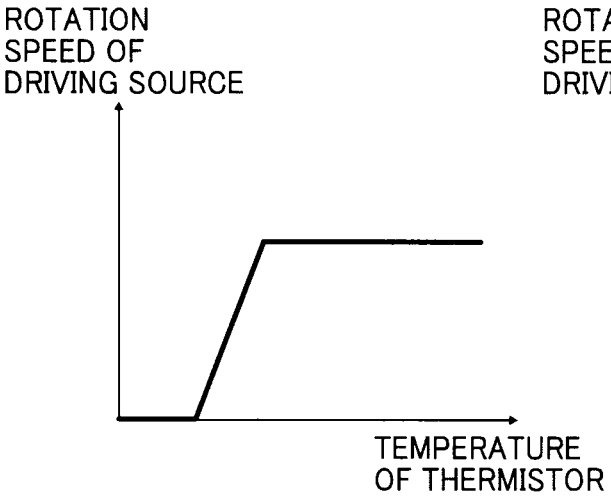
FIG. 11A is a chart illustrating an example of control of changing the rotation speed relative to temperature of the thermistor and FIG. 11B is a chart illustrating another example of control of changing rotation speed relative to the temperature of the thermistor.

Specifically, in the second exemplary embodiment, as illustrated in FIG. 11A, the rotation speed of the pressing roller 31 (or the rotation speed of the fixing belt 21) is continuously adjusted in accordance with the temperature detected by the thermistor 28.

Figure 11B:
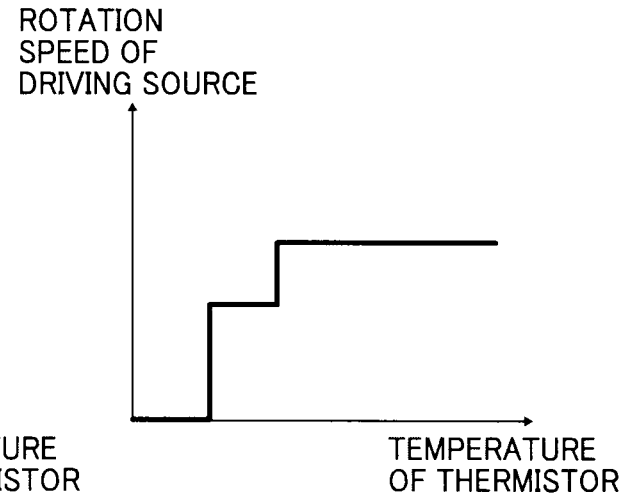

Alternatively, as illustrated in FIG. 11B, the rotation speed (of the fixing belt 21 or the pressing roller 31 or the rotation drive speed of the rotary drive unit) is set to zero (i.e., drive stop state) until the temperature of the thermistor 28 reaches a predetermined temperature. When the temperature of the thermistor 28 reaches the predetermined temperature, the rotation speed is linearly and continuously increased.

Figure 12:
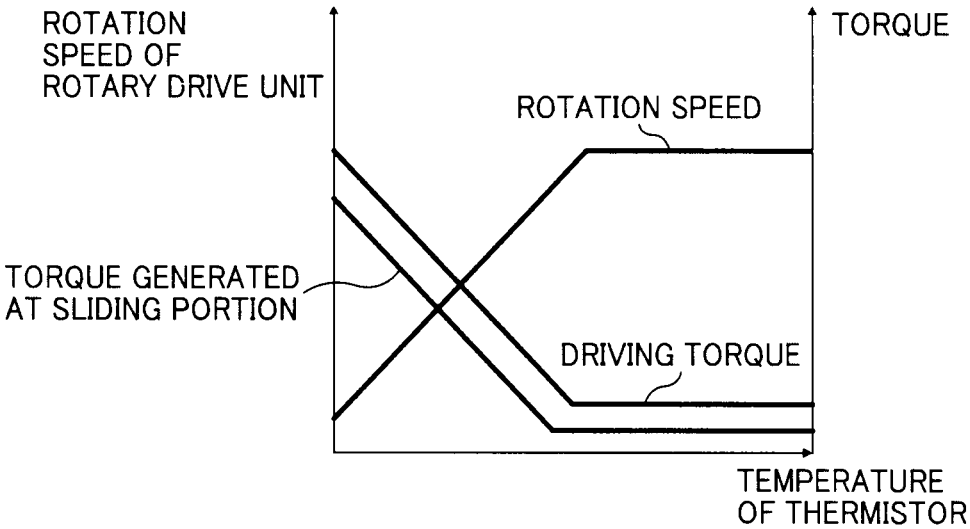
FIG. 12 is a chart illustrating a relation between the temperature of the thermistor and the rotation speed/torque of the rotary drive unit.

As illustrated in FIG. 12, when the rotation speed is continuously increased, the driving torque is continuously reduced.

Meanwhile, as the temperature detected by the thermistor 28 rises, the viscosity of the lubricant 40 continuously decreases. Accordingly, the friction resistance at the sliding portion between the fixing belt 21 and the heat conductive member 22 continuously decreases, and as a result, the torque occurring at the sliding portion continuously decreases.

Such a configuration reduces the torque occurring at the sliding portion to be not more than a permissible torque of the rotary drive unit, preventing damage of the rotary drive unit.

In this regard, it might be difficult to continuously change the rotation speed due to properties of the driving motor or other related/connecting members, such as drive gears, of the rotary drive unit. In such a case, the rotation speed of the rotary drive unit, e.g., the rotation speed of the fixing belt 21 may be adjusted in discrete, discontinuous steps, and achieve the same effect.

Generally, a fixing device may adjust a rotation speed of a fixing belt to deal with different thicknesses of sheets of paper. Specifically, for a recording medium, such as cardboard or OHP sheet, requiring a relatively large amount of heat to fix a toner image thereon, such a fixing device may reduce the rotation speed of the fixing belt by, e.g., approximately one half or one third of a rotation speed in printing a plain sheet of paper. Thus, a time during which the recording medium passes a fixing nip is lengthened to apply a relatively large amount of heat to the toner image on the recording medium.

As described above, typically, a fixing devise is designed to be able to rotate at a plurality of predefined different rotation speeds to furnish the above-described fixing capability. Hence, in the second exemplary embodiment, the fixing device can easily increase the rotation speed in discrete, discontinuous steps using such a plurality of predefined rotation speeds.

Specifically, for example, as illustrated in FIG. 11B, the rotation speed is adjusted in accordance with the temperature detected by the thermistor 28 in two steps to reduce the permissible torque of the rotary drive unit in discrete, discontinuous steps. Moreover, it is to be noted that the number of steps is not limited to two and may be three or more.

Next, a fixing device according to a third exemplary embodiment of the present disclosure is described below.

By way of explanatory background, it is to be noted that when a small-size sheet passes the fixing device, the temperature of a non sheet-passing area of the fixing nip N at which the small-size sheet does not pass decreases. As a result, the viscosity of the lubricant 40 at the non-sheet-passing area may decrease, increasing the friction resistance of the sliding portion between the fixing belt 21 and the heat conductive member 22 at the non sheet-passing area. To prevent such increase of the friction resistance, in the third exemplary embodiment, a halogen heater 25 is provided that is capable of heating the non sheet-passing area. When the small-size sheet passes the fixing nip N, power is supplied to the halogen heater 25 to heat the non sheet-passing area.

Figure 13:
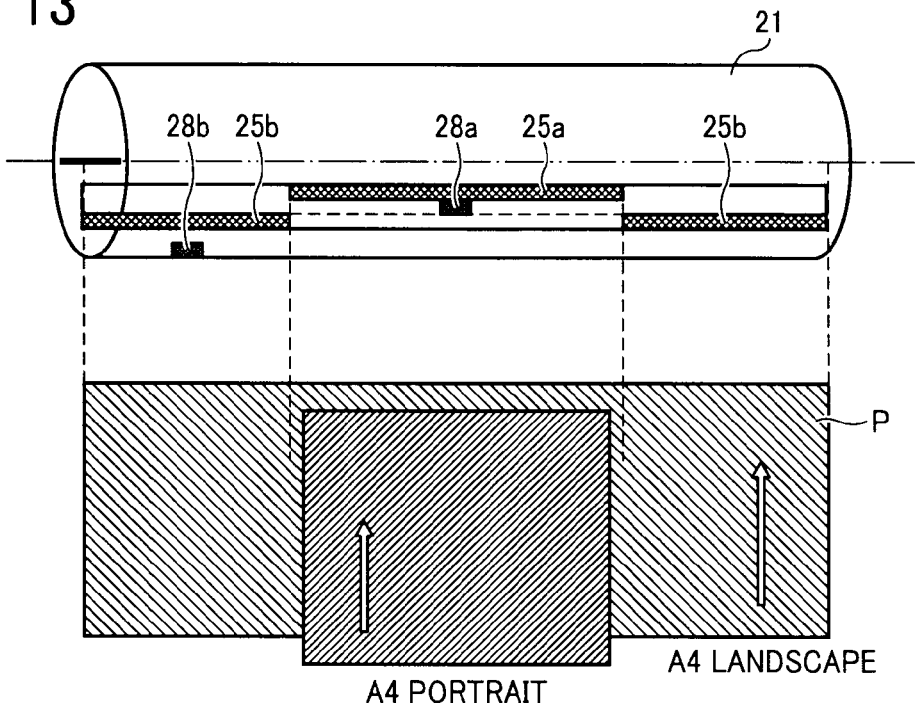
FIG. 13 is a partial side view illustrating a fixing device according to another illustrative embodiment.

FIG. 13 is a schematic view illustrating an installed state of the halogen heater 25 seen from one side of the fixing device illustrated in FIG. 4. As illustrated in FIG. 13, the halogen heater 25 includes a central halogen heater 25*a*and end-portion halogen heaters 25*b*. The central halogen heater 25*a*heats a central portion of the heat conductive member 22 in a longitudinal direction (axial direction) of the heat conductive member 22 so as to heat an area corresponding to a width of a A4-size recording medium in portrait orientation. The end-portion halogen heaters 25*b*heat end portions of the heat conductive member 22 in the longitudinal direction (axial direction) of the heat conductive member 22 so as to heat an area corresponding to a width of a A4-size recording medium in landscape orientation.

Further, a central thermistor 28*a*and end-portion thermistors 28*b*are provided corresponding to the central halogen heater 25*a*and the end-portion halogen heaters 25*b*.

A halogen heater may include a glass tube and a tungsten wire coiled within the glass tube. Accordingly, the central halogen heater 25*a*may slightly heat the end-portions of the heat conductive member 22 in the longitudinal direction of the heat conductive member 22, and the end-portion halogen heaters 25*b*may slightly heat the central portion of the heat conductive member 22 in the longitudinal direction of the heat conductive member 22. However, the term "primary heating area" used herein does not include such minor heating areas and can be ignored.

When a small-size sheet (e.g., A4-size sheet in portrait orientation) passes the fixing device, in a conventional type of heating control, the end-portion halogen heaters 25*b*would not be turned on because the sheet does not pass the primary heating areas of the end-portion halogen heaters 25*b*.

Likewise, such control is performed on a small-size sheet, such as a B5-size sheet in portrait orientation or an A6-size sheet portrait orientation, of a width smaller than the width of a A4-size sheet in portrait orientation.

Figure 14:
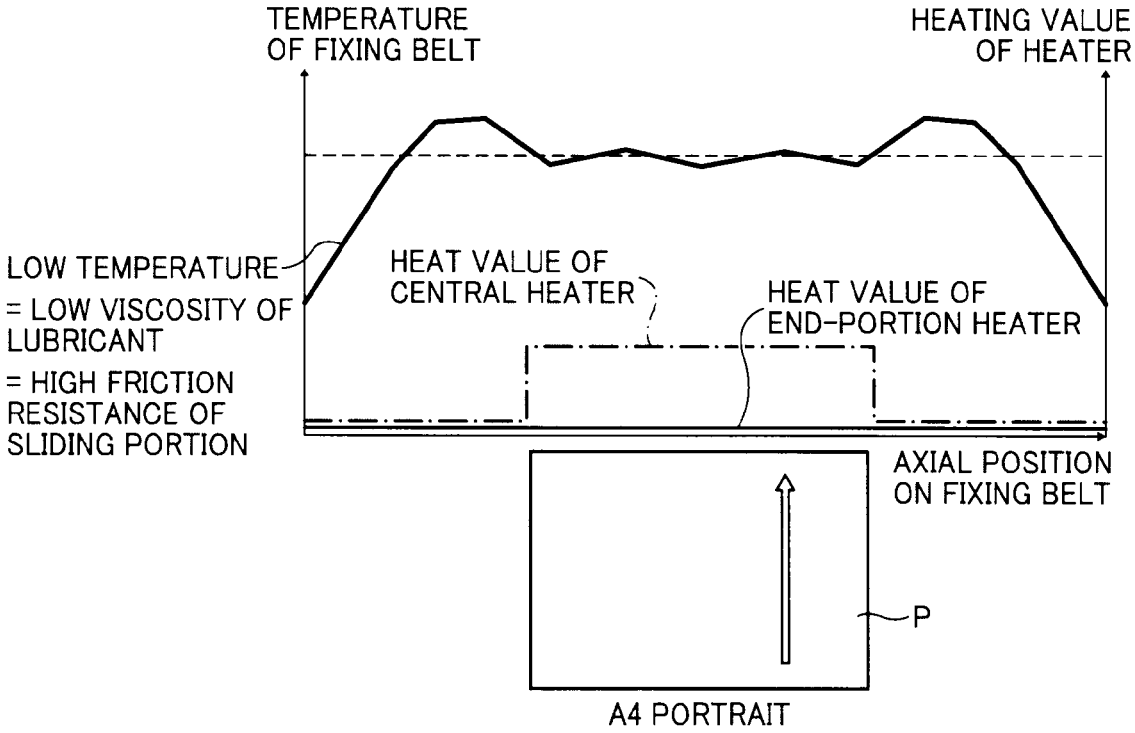
FIG. 14 is a diagram illustrating a temperature distribution of a fixing belt obtained with end-portion halogen heaters turned off.

As described above, when a small-size sheet passes the fixing device with the end-portion halogen heaters 25*b*turned off, the temperature of the fixing belt 21 in the axial direction thereof during sheet passing shows a distribution as illustrated in FIG. 14.

As illustrated in FIG. 14, when a small-size sheet passes the fixing device with the end-portion halogen heaters 25*b*turned off, the temperature of the fixing belt 21 rises at edge portions of the sheet while decreasing at outer areas in the axial direction of the fixing belt 21. Accordingly, the viscosity of the lubricant 40 gradually increases at the outer areas at which the temperature of the fixing belt 21 decreases, increasing the friction resistance of the sliding portion between the fixing belt 21 and the heat conductive member 22 and causing uneven distribution of the friction resistance at the sliding portion between the fixing belt 21 and the heat conductive member 22. Consequently, the fixing belt 21 may not be smoothly rotated and might damage the rotary drive unit.

Figure 15:
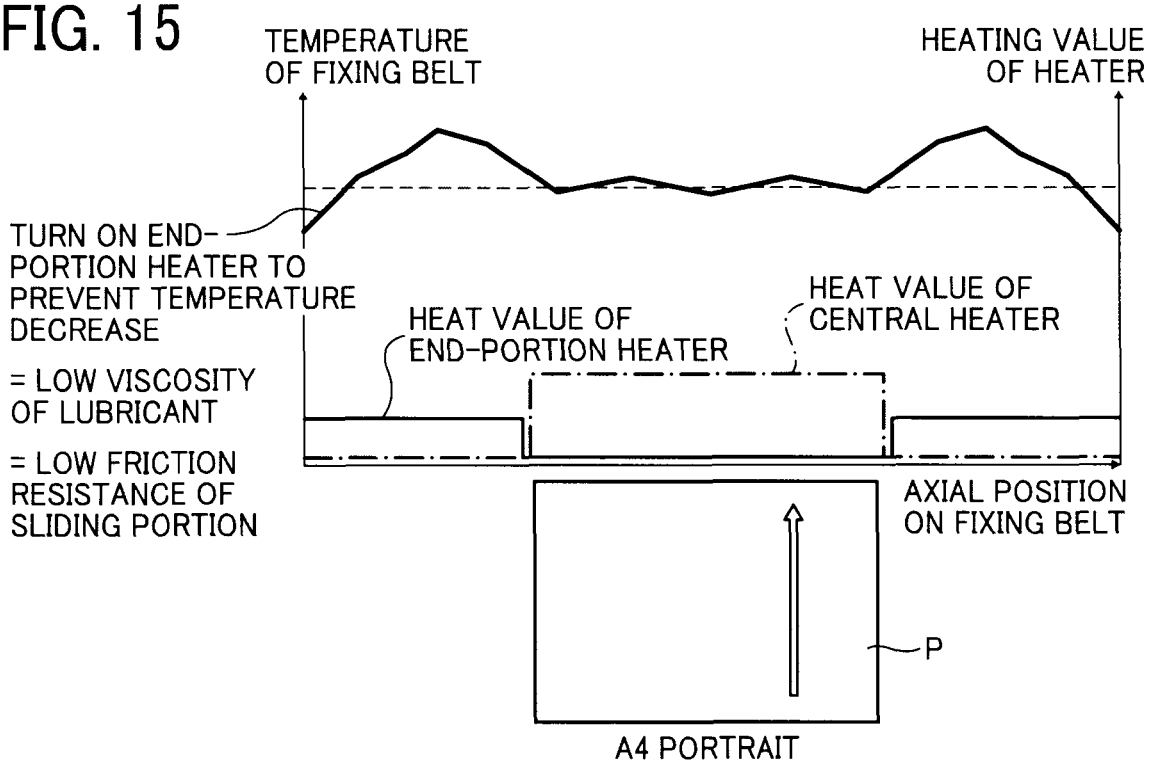

Hence, in the third exemplary embodiment, when a small-size sheet passes the fixing device, the heating member (e.g., the end-portion halogen heater 25*b*in FIG. 13) that heats the non sheet-passing area as the primary heating area is also turned on to prevent the above-described reduction in the temperature of the non sheet-passing area. Thus, when a small-size sheet passes the fixing device with the end-portion halogen heaters 25*b*turned on, the fixing belt 21 shows a temperature distribution illustrated in FIG. 15 in the axial direction of the heat conductive member 22. Such a configuration can prevent an increase in the viscosity of the lubricant 40 at the non sheet-passing area, and as a result, reduce the friction resistance at the sliding portion between the fixing belt 21 and the heat conductive member 22.

Figure 16:
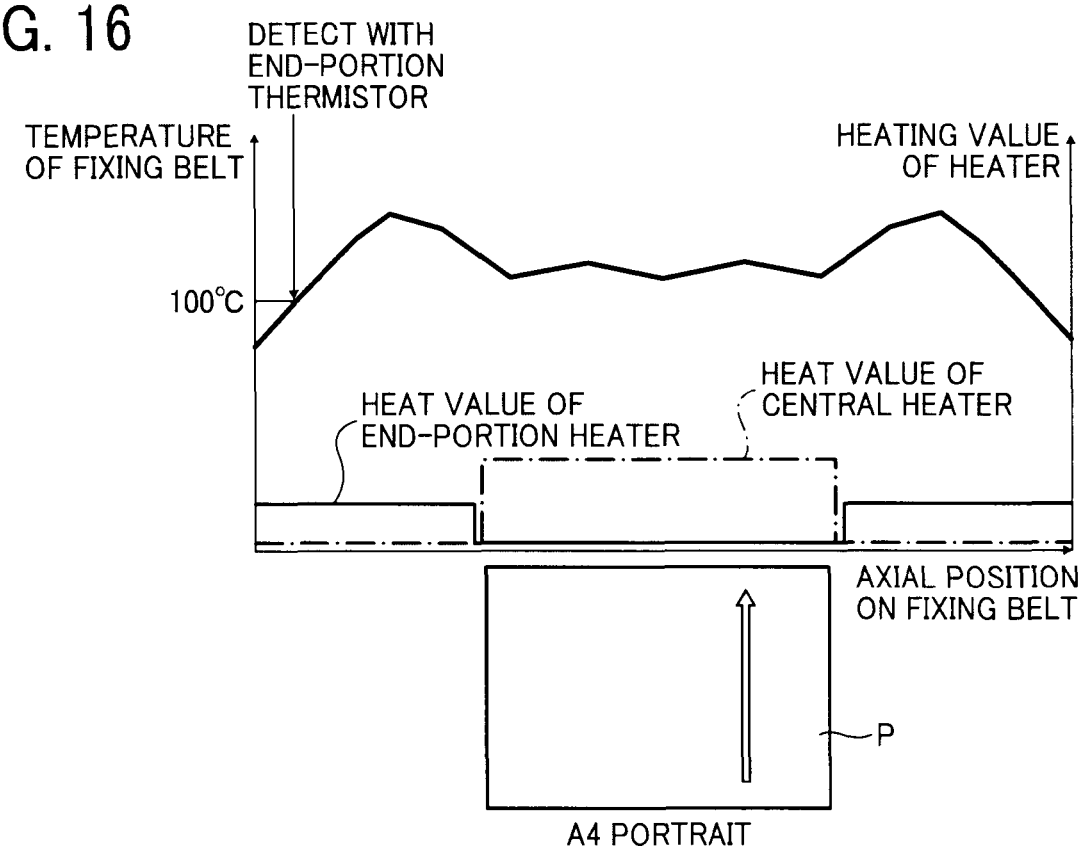
FIG. 16 is a diagram illustrating a temperature distribution of the fixing belt obtained when the temperature of the end-portion halogen heaters is maintained at 100 degrees C. or more.

Alternatively, as illustrated in FIG. 16, the temperature of the fixing belt 21 can be maintained using the end-portion halogen heaters 25*b*in such a way that the temperature of the non sheet-passing area detected by the end-portion thermistor 28*b*is maintained at 100 degrees C. or higher.

One reason for setting 100 degrees C. or more as the threshold temperature is that, as illustrated in FIG. 10, the torque occurring at the sliding portion between the fixing belt 21 and the heat conductive member 22 shrinks significantly as compared with a permissible torque of the rotary drive unit at that temperature, thereby providing a significant increase in the durability.

As described above, in the third exemplary embodiment, when a small-size sheet passes the fixing device, the heating member that heats the non sheet-passing area as the primary heating area is also turned on. Such a configuration prevents a decrease in the temperature of the non sheet-passing area, thus preventing an increase in the viscosity of the lubricant 40.

Figure 17:
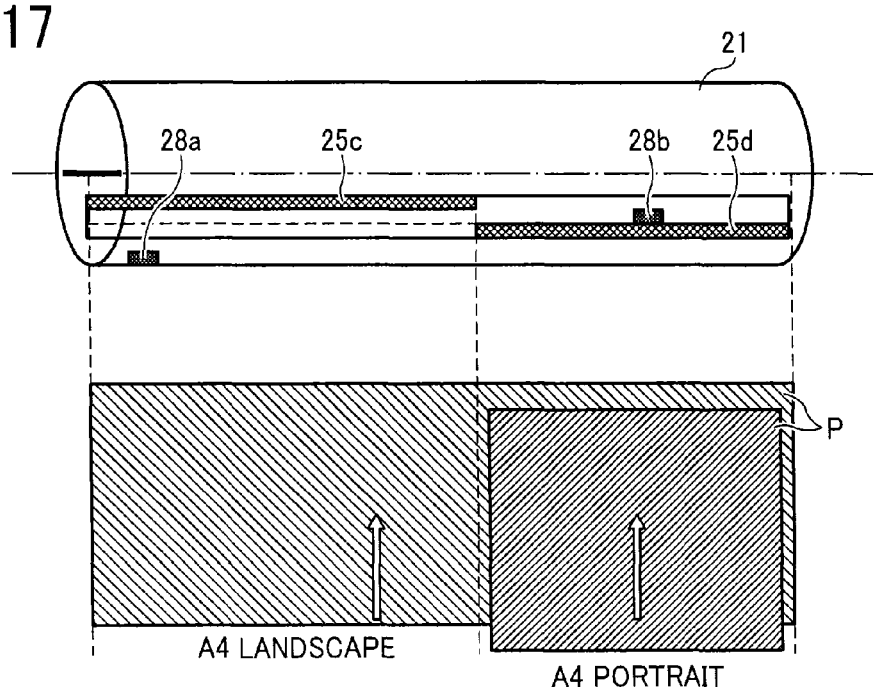
FIG. 17 is a side view illustrating another arrangement of halogen heaters and thermistors.

In the above description, the configuration of the third exemplary embodiment is described based on the distinction between the central halogen heater 25*a*and the end-portion halogen heaters 25*b*. Alternatively, as a variation, for example, as illustrated in FIG. 17, the halogen heater 25 may include a halogen heater 25*c*for large-size sheet and a halogen heater 25*d*for small-size sheet. In such a case, when a small-size sheet passes the fixing device, the halogen heater 25*c*for large-size sheet is turned on. As with the above-described configuration illustrated in FIG. 13, such a configuration can prevent a decrease in the temperature of the non sheet-passing area.

Figure 18:
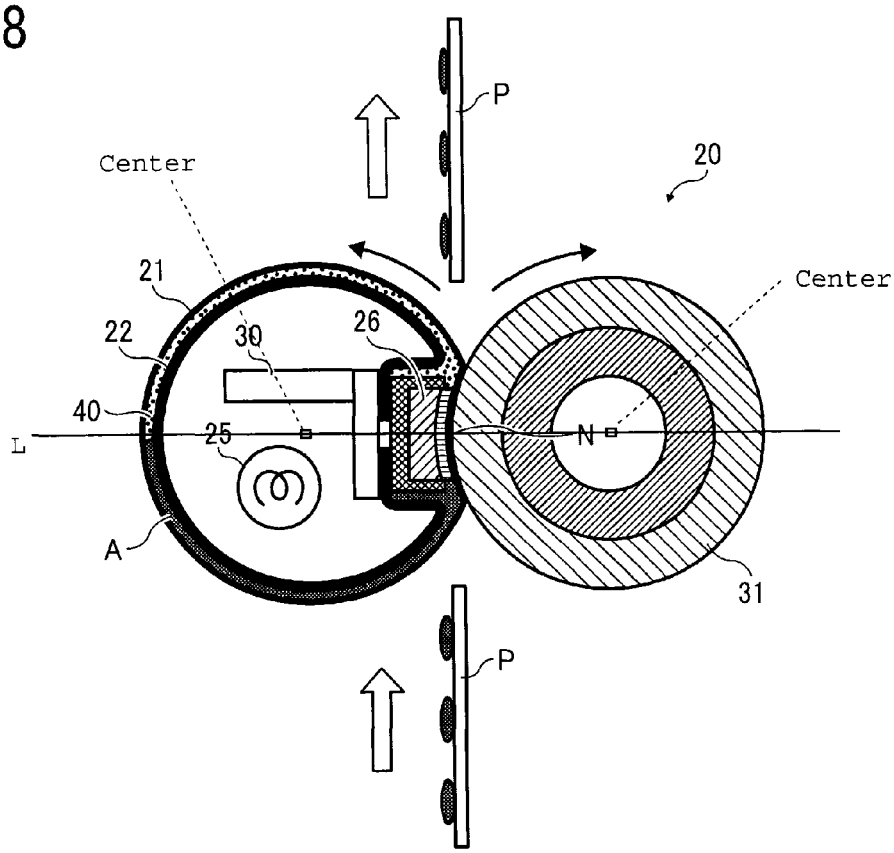
FIG. 18 is a cross-sectional elevation view illustrating an arrangement of components of the fixing device.

The above-described arrangement of components of the fixing device according to the present exemplary embodiment can be applied to a vertical-conveyance type of fixing device illustrated in FIG. 18, in which a line L connecting the axial center of the fixing belt 21 and the axial center of the pressing roller 31 is 45 degrees or less relative to the horizontal direction (e.g., substantially zero in FIG. 18). Alternatively, the arrangement of components of the fixing device may be applied to a horizontal-conveyance type of fixing device illustrated in FIG. 19.

When the fixing device is not operated for a long time, the lubricant 40 may accumulate in a lower portion of the fixing device by gravitation. For example, in FIGS. 18 and 19, the lubricant 40 may accumulate at positions A and B.

For example, as illustrated in FIG. 18, when the fixing device 20 is configured as a vertical-conveyance type of fixing device, the fixing device 20 can heat such an area in which the lubricant 40 accumulates, thus reducing the viscosity of the lubricant 40.

Figure 19:
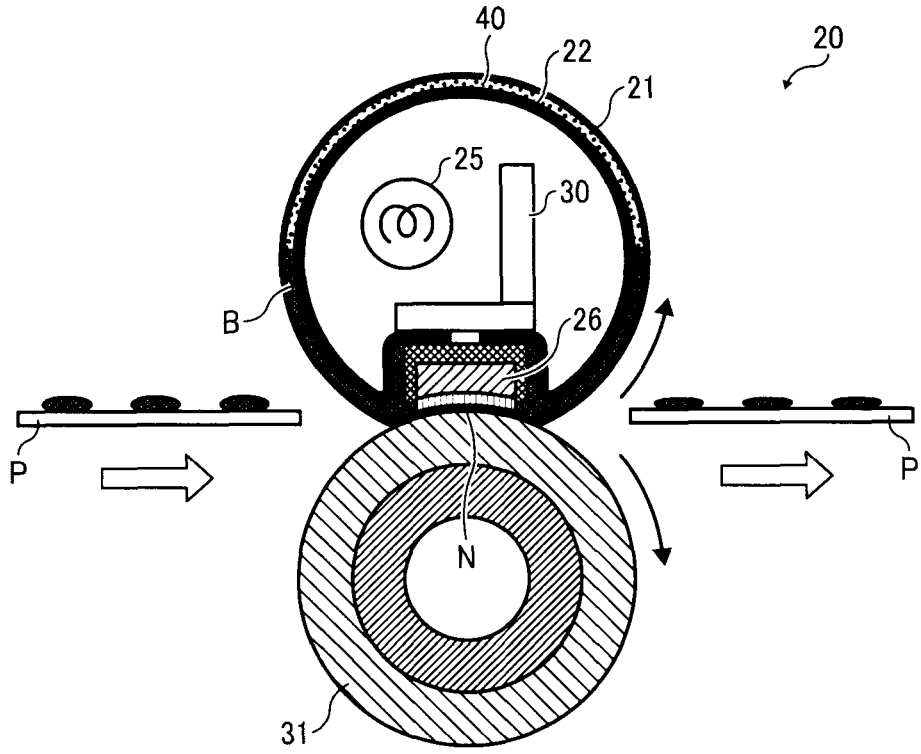
FIG. 19 is a cross-sectional elevation view illustrating another arrangement of components of the fixing device.

Alternatively, as illustrated in FIG. 19, when the fixing device 20 is configured as a horizontal-conveyance type of fixing device, the lubricant 40 may also accumulate in an area outside the area heated by the halogen heater 25. Accordingly, the effect of reducing the viscosity of the lubricant 40 is smaller than in the vertical-conveyance type of fixing device.

In the present exemplary embodiment, the lubricant 40 covers over substantially the entire area of the interface between the fixing belt 21 and the heat conductive member 22. However, it is to be noted that, if the lubricant 40 covers over at least half or more of the contact area between the fixing belt 21 and the heat conductive member 22, the viscosity of the lubricant 40 has a greater ameliorative effect on the friction resistance between the fixing belt 21 and the heat conductive member 22. Accordingly, in the fixing device having the above-described configuration, greater reduction of the friction resistance can be obtained.

In addition, a further greater effect can be obtained when the area heated by the heating member is relatively large as compared to the area in which the lubricant 40 lies.

Accordingly, in the configuration in which at least half of the area including the lubricant 40 is heated, the effect of reducing the viscosity of the lubricant 40 due to temperature rise of the lubricant 40 is relatively large, resulting in a larger effect of reducing the friction resistance.

Figure 20:
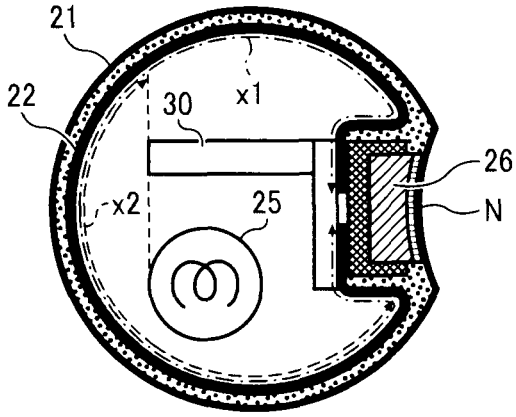
FIG. 20 is a schematic view illustrating a relation between a lubricant cover area and a heated area.

For example, assume that the amount of the lubricant 40 is substantially uniform in the axial direction of each of the fixing belt 21 and the heat conductive member 22. As illustrated in FIG. 20, if a length X2 of the area heated by the halogen heater 25 is half of or greater than half of a length X1 of the area in which the lubricant 40 covers in a circumferential direction of the fixing belt 21 and the heat conductive member 22, heating with the halogen heater 25 can increase the temperature of an area half of or greater than half of the area covered with the lubricant 40. Accordingly, a relatively large effect of reducing the viscosity of the lubricant 40 due to temperature increase can be obtained, thus providing a greater effect of reducing the friction resistance.

Figure 21:
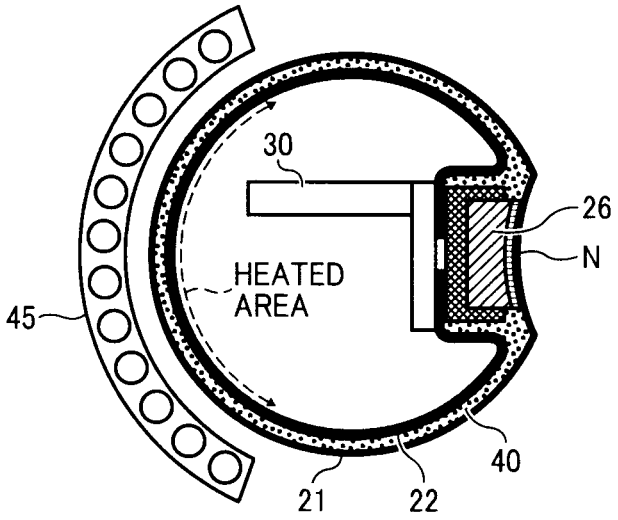
FIG. 21 is a schematic view illustrating another The accompanying drawings are intended to depict exemplary embodiments of the present disclosure and should not be interpreted to limit the scope thereof. The accompanying drawings are not to be considered as drawn to scale unless explicitly noted.

In the above-described exemplary embodiment, the halogen heater 25 serving as the heat source is provided inside the heat conductive member 22. Alternatively, to enhance its temperature raising performance, the fixing device 20 may include an induction heater 45 as illustrated in FIG. 21. In FIG. 21, the induction heater 45 is provided outside the loop formed by the fixing belt 21 to face the outer circumferential surface of the fixing belt 21, and heats the fixing belt 21 by using electromagnetic induction of induction heating (IH).

The induction heater 45 includes an exciting coil, a core, and a coil guide. The exciting coil includes litz wires formed of bundled thin wires and extended in the width direction of the fixing belt 21 to cover a part of the fixing belt 21. The coil guide includes heat-resistant resin and holds the exciting coil and the core. The core is a semi-cylindrical member formed of a ferromagnet (e.g., ferrite) having relative magnetic permeability in a range of from about 1,000 to about 3,000. The core includes a center core and a side core to generate magnetic fluxes toward the heat conductive member 22 effectively. The core is disposed opposite the exciting coil extending in the width direction of the fixing belt 21.

The following describes operation of the fixing device 21 including the induction heater 45 having the above-described structure.

When the fixing belt 21 rotates in the rotation direction R2, the induction heater 45 heats the fixing belt 21 at a position at which the fixing belt 21 faces the induction heater 45. Specifically, a high-frequency alternating current is applied to the exciting coil to generate magnetic lines of force around the heat conductive member 22 in such a manner that the magnetic lines of force are alternately switched back and forth.

Accordingly, an eddy current generates on a surface of the heat conductive member 22, and electric resistance of the heat conductive member 22 generates Joule heat. The Joule heat heats the heat conductive member 22 by electromagnetic induction, and the heated heat-conductive member 22 heats the fixing belt 21.

In order to heat the heat conductive member 22 effectively by electromagnetic induction, the induction heater 45 may face the heat conductive member 22 in an entire circumferential direction of the heat conductive member 22. The heat conductive member 22 may include nickel, stainless steel, iron, copper, cobalt, chrome, aluminum, gold, platinum, silver, tin, palladium, an alloy of a plurality of those metals, and/or the like.

In the present exemplary embodiment, the heat conductive member 22 contacts or faces the inner circumferential surface of the fixing belt 21 to support or hold the fixing belt 21 to heat the fixing belt 22. The heat conductive member 22 may be manufactured by bending a thin metal plate into a pipe shape at relatively reduced manufacturing costs, enhancing heating efficiency for heating the fixing belt 21, shortening a warm-up time or a first print time, and suppressing faulty fixing which may occur when the fixing device 20 is driven at high speed.

In the heat conductive member 22, as illustrated in FIG. 4, if the lateral edge portion 22*b*remains open after the thin metal plate is bent into the pipe shape, the inherent spring-back of the thin metal plate might enlarge the opening of the lateral edge portion 22*b*. Consequently, the heat conductive member 22 might not contact or press against the fixing belt 21 with uniform pressure.

Hence, at least a part of the lateral edge portion 22*b*in a width direction, that is, an axial direction, of the heat conductive member 22 may be jointed to prevent the spring-back of the heat conductive member 22 from enlarging the opening of the lateral edge portion 22*b*. For example, the lateral edge portion 22*b*may be jointed by welding.

In the heat conductive member 22 illustrated in FIG. 4, the recessed portion 22*a*is provided to accommodate the nip formation member 26. If the corner portions 22*c*and the nearby portions of the heat conductive member 22 in the recessed portion 22*a*press against the pressing roller 31 via the fixing belt 21, pressure applied by the pressing roller 31 may deform the heat conductive member 22. Accordingly, the heat conductive member 22 may not contact or press against the fixing belt 21 with uniform pressure.

Hence, according to the above-described exemplary embodiments, the heat conductive member 22 including the corner portions 22*c*does not press against the pressing roller 31 via the fixing belt 21. For example, the corner portions 22*c*are provided at positions separated from the fixing nip N so that the corner portions 22*c*are separated from the pressing roller 31.

According to the above-described exemplary embodiments, the fixing device 20 employs the pressing roller 31 as a pressing member. Alternatively, a pressing belt or a pressing pad may be used as a pressing member to provide effects equivalent to the above-described effects provided by the fixing device 20 including the pressing roller 31.

According to the above-described exemplary embodiments, the fixing belt 21 having a multi-layered structure is used as a fixing member. Alternatively, an endless fixing film including polyimide resin, polyamide resin, fluorocarbon resin, and/or thin metal may be used as a fixing member to provide effects equivalent to the above-described effects provided by the fixing device 20 including the fixing belt 21.

As described above, the fixing device according to any of the above-described exemplary embodiments includes the fixing member, the heat conductive member, and lubricant lying between the fixing member and the heat conductive member. With the fixing member stopped, the fixing device heats the heat conductive member using the heating member and, after the heating of the heat conductive member, rotates the fixing member. Such a configuration allows the fixing member to rotate after the viscosity of lubricant is reduced. Accordingly, the friction resistance of the sliding portion between the fixing member and the heat conductive member can be reduced, allowing stable operation of the fixing member, a reduced driving torque of the rotary drive unit that drives the fixing member, and a reduced load of the rotary drive unit. Thus, damage of the rotary drive unit can be prevented, allowing extension of the product life of the fixing device.

Further, the image forming apparatus including the fixing device according to any one of the above-described exemplary embodiments performs excellent and stable fixing processing to form a high quality image and achieves an increased product life.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different exemplary embodiments may be combined with each other and/or substituted for each other within the scope of this disclosure and appended claims.

What is claimed is:

1. A fixing device for fixing an image on a recording medium, the fixing device comprising:

an endless flexible fixing member formed into a loop;

a heat conductive member disposed within the loop formed by the fixing member, the fixing member movable along the heat conductive member;

a heater disposed near the heat conductive member to heat the heat conductive member;

a pressing member that presses a nip formation member via the fixing member to form a fixing nip between the fixing member and the pressing member, through which the recording medium passes;

a temperature sensor to detect a temperature of the fixing member; and a lubricant disposed between the fixing member and the heat conductive member, the heater heating the heat conductive member to heat the lubricant with the fixing member stopped, the fixing member rotating after heating of the heat conductive member by the heater, wherein a line connecting an axial center of the fixing member and an axial center of the pressing member is at not more than 45 degrees relative to a horizontal direction, and wherein the pressing member does not press the heat conductive member.

2. The fixing device according to claim 1, wherein the heating of the heat conductive member by the heater finishes in accordance with the temperature of the fixing member detected by the temperature sensor.

3. The fixing device according to claim 1, wherein the heating of the heat conductive member by the heater finishes when the temperature of the fixing member is not less than 100 degrees centigrade.

4. The fixing device according to claim 1, wherein a rotation speed of the fixing member is changed in accordance with the temperature of the fixing member detected by the temperature sensor.

5. The fixing device according to claim 4, wherein the rotation speed of the fixing member is changed continuously in accordance with the temperature of the fixing member detected by the temperature sensor.

6. The fixing device according to claim 4, wherein the rotation speed of the fixing member is changed in discrete, discontinuous steps in accordance with the temperature of the fixing member detected by the temperature sensor.

7. The fixing device according to claim 1, wherein the heater comprises a plurality of heating members, wherein the fixing nip comprises a first area through which the recording medium passes and a second area through which the recording medium does not pass, and at least one of the plurality of heating members is disposed at a position corresponding to the second area of the fixing nip and heats the heat conductive member when the recording medium passes the first area of the fixing nip.

8. The fixing device according to claim 7, wherein when the recording medium passes the first area of the fixing nip, the at least one of the plurality of heating members heats the heat conductive member to raise the temperature of the fixing member at the second area to at least 100 degrees centigrade.

9. The fixing device according to claim 1, wherein the lubricant covers at least half of an area over which the fixing member contacts the heat conductive member.

10. The fixing device according to claim 1, wherein the heater heats at least half of an area at which the lubricant disposed between the fixing member and the heat conductive member.

11. The fixing device according to claim 1, wherein the fixing member is a flexible endless belt.

12. The fixing device according to claim 1, wherein the heat conductive member is a metal pipe.

13. The fixing device according to claim 1, wherein the heater is disposed outside the loop formed by the fixing member.

14. The fixing device according to claim 1, wherein a difference between a diameter of the heat conductive member and a diameter of the fixing member is set to no greater than 1 mm.

15. The fixing device according to claim 14, wherein a difference between a diameter of the heat conductive member and a diameter of the fixing member is larger next to the pressing member than away from the pressing member.

16. An image forming apparatus, comprising:

an image forming unit that forms an image on a recording medium; and a fixing device that fixes the image, formed by the image forming unit, on the recording medium, the fixing device comprising:

an endless flexible fixing member formed into a loop;

a heat conductive member disposed within the loop formed by the fixing member, the fixing member movable along the heat conductive member;

a heater disposed near the heat conductive member to heat the heat conductive member;

a pressing member that presses a nip formation member via the fixing member to form a fixing nip between the fixing member and the pressing member through which the recording medium passes;

a temperature sensor to detect a temperature of the fixing member; and a lubricant disposed between the fixing member and the heat conductive member, the heater heating the heat conductive member to heat the lubricant with the fixing member stopped, the fixing member rotating after heating of the heat conductive member by the heater, wherein a line connecting an axial center of the fixing member and an axial center of the pressing member is at not more than 45 degrees relative to a horizontal direction, and wherein the pressing member does not press the heat conductive member.

17. A fixing device for fixing an image on a recording medium, the fixing device comprising:

an endless flexible fixing member formed into a loop;

a heat conductive member disposed within the loop formed by the fixing member, the fixing member movable along the heat conductive member;

a heater disposed near the heat conductive member to heat the heat conductive member;

a pressing member that presses a nip formation member via the fixing member to form a fixing nip between the fixing member and the pressing member, through which the recording medium passes;

a temperature sensor to detect a temperature of the fixing member; and a lubricant disposed between the fixing member and the heat conductive member, the heater heating the heat conductive member to heat the lubricant with the fixing member stopped, the fixing member rotating after heating of the heat conductive member by the heater, wherein the heat conductive member comprises corner portions which are not pressed by the pressing member via the fixing member.

18. An image forming apparatus, comprising:

an image forming unit that forms an image on a recording medium; and a fixing device that fixes the image, formed by the image forming unit, on the recording medium, the fixing device comprising:

an endless flexible fixing member formed into a loop;

a heat conductive member disposed within the loop formed by the fixing member, the fixing member movable along the heat conductive member;

a heater disposed near the heat conductive member to heat the heat conductive member;

a pressing member that presses a nip formation member via the fixing member to form a fixing nip between the fixing member and the pressing member through which the recording medium passes;

a temperature sensor to detect a temperature of the fixing member; and a lubricant disposed between the fixing member and the heat conductive member, the heater heating the heat conductive member to heat the lubricant with the fixing member stopped, the fixing member rotating after heating of the heat conductive member by the heater, wherein the heat conductive member comprises corner portions which are not pressed by the pressing member via the fixing member.

* * * * *